US007990072B2

(12) United States Patent
Jin

(10) Patent No.: US 7,990,072 B2
(45) Date of Patent: Aug. 2, 2011

(54) BALANCING ARRANGEMENT WITH REDUCED AMOUNT OF BALANCING TRANSFORMERS

(75) Inventor: Xiaoping Jin, Orange, CA (US)

(73) Assignee: Microsemi Corporation, Garden Grove, CA (US)

( * ) Notice: Subject to any disclaimer, the term of this patent is extended or adjusted under 35 U.S.C. 154(b) by 368 days.

(21) Appl. No.: 12/363,807

(22) Filed: Feb. 2, 2009

(65) Prior Publication Data

US 2009/0195178 A1 Aug. 6, 2009

Related U.S. Application Data

(63) Continuation-in-part of application No. 11/937,693, filed on Nov. 9, 2007, which is a continuation of application No. 10/959,667, filed on Oct. 5, 2004, now Pat. No. 7,294,971.

(60) Provisional application No. 61/026,227, filed on Feb. 5, 2008, provisional application No. 61/055,993, filed on May 25, 2008, provisional application No. 61/114,124, filed on Nov. 13, 2008, provisional application No. 60/508,932, filed on Oct. 6, 2003.

(51) Int. Cl.
*H05B 37/00* (2006.01)
*H05B 39/00* (2006.01)

(52) U.S. Cl. ..... 315/282; 315/177; 315/277

(58) Field of Classification Search ..... 315/282, 315/312, 121, 255, 177, 277, 130, 246
See application file for complete search history.

(56) References Cited

U.S. PATENT DOCUMENTS

| | | | |
|---|---|---|---|
| 2,429,162 | A | 10/1947 | Keiser et al. |
| 2,440,984 | A | 5/1948 | Summers |
| 2,572,258 | A | 10/1951 | Goldfield et al. |
| 2,965,799 | A | 12/1960 | Brooks et al. |
| 2,968,028 | A | 1/1961 | Goto et al. |
| 3,141,112 | A | 7/1964 | Eppert |
| 3,565,806 | A | 2/1971 | Ross |
| 3,597,656 | A | 8/1971 | Douglas |

(Continued)

FOREIGN PATENT DOCUMENTS

EP 0326114 8/1989

(Continued)

OTHER PUBLICATIONS

Williams, B.W.; "Power Electronics Devices, Drivers, Applications and Passive Components"; Second Edition, McGraw-Hill, 1992; Chapter 10, pp. 218-249.

(Continued)

*Primary Examiner* — Daniel D Chang
(74) *Attorney, Agent, or Firm* — Simon Kahn

(57) ABSTRACT

A backlighting arrangement constituted of: a driving transformer; at least one balancing transformer; a plurality of luminaires, a first end of each of the plurality of luminaires connected to a high voltage lead of the driving transformer and a second end of each of the plurality of luminaires connected to a unique end of a winding of the at least one balancing transformer, wherein each pair of the luminaires is associated with a particular winding of one of the at least one balancing transformers, and wherein the first end and the second end of each of the luminaires is in physical proximity of the driving transformer and the at least one balancing transformer, the constituent lamps of the luminaires arranged in parallel and generally extending axially away from the proximity of the driving transformer.

21 Claims, 8 Drawing Sheets

U.S. PATENT DOCUMENTS 3,611,021 A 10/1971 Wallace
3,683,923 A 8/1972 Anderson
3,737,755 A 6/1973 Calkin et al.
3,742,330 A 6/1973 Hodges et al.
3,936,696 A 2/1976 Gray
3,944,888 A 3/1976 Clark
4,060,751 A 11/1977 Anderson
4,353,009 A 10/1982 Knoll
4,388,562 A 6/1983 Josephson
4,441,054 A 4/1984 Bay
4,463,287 A 7/1984 Pitel
4,523,130 A 6/1985 Pitel
4,562,338 A 12/1985 Okami
4,567,379 A 1/1986 Corey et al.
4,572,992 A 2/1986 Masaki
4,574,222 A 3/1986 Anderson
4,622,496 A 11/1986 Dattilo et al.
4,630,005 A 12/1986 Clegg et al.
4,663,566 A 5/1987 Nagano
4,663,570 A 5/1987 Luchaco et al.
4,672,300 A 6/1987 Harper
4,675,574 A 6/1987 Delflache
4,686,615 A 8/1987 Ferguson
4,698,554 A 10/1987 Stupp et al.
4,700,113 A 10/1987 Stupp et al.
4,761,722 A 8/1988 Pruitt
4,766,353 A 8/1988 Burgess
4,780,696 A 10/1988 Jirka
4,847,745 A 7/1989 Shekhawat et al.
4,862,059 A 8/1989 Tominaga et al.
4,893,069 A 1/1990 Harada et al.
4,902,942 A 2/1990 El-Hamamsy
4,939,381 A 7/1990 Shibata et al.
5,023,519 A 6/1991 Jensen
5,030,887 A 7/1991 Guisinger
5,036,255 A 7/1991 McKnight et al.
5,057,808 A 10/1991 Dhyanchand
5,173,643 A 12/1992 Sullivan et al.
5,349,272 A 9/1994 Rector
5,434,477 A 7/1995 Crouse et al.
5,475,284 A 12/1995 Lester et al.
5,485,057 A 1/1996 Smallwood et al.
5,519,289 A 5/1996 Katyl et al.
5,539,281 A 7/1996 Shackle et al.
5,557,249 A 9/1996 Reynal
5,563,473 A 10/1996 Mattas et al.
5,574,335 A 11/1996 Sun
5,574,356 A 11/1996 Parker
5,615,093 A 3/1997 Nalbant
5,619,402 A 4/1997 Lin
5,621,281 A 4/1997 Kawabata et al.
5,652,479 A 7/1997 LoCascio et al.
5,712,776 A 1/1998 Palara et al.
5,754,012 A 5/1998 LoCascio et al.
5,818,172 A 10/1998 Lee
5,822,201 A 10/1998 Kijima
5,825,133 A 10/1998 Conway
5,828,156 A 10/1998 Roberts
5,854,617 A 12/1998 Lee et al.
5,892,336 A 4/1999 Lin et al.
5,910,713 A 6/1999 Nishi et al.
5,912,812 A 6/1999 Moriarty, Jr.
5,914,842 A 6/1999 Sievers
5,923,129 A 7/1999 Henry
5,930,121 A 7/1999 Henry
5,930,126 A 7/1999 Griffin et al.
5,936,360 A 8/1999 Kaneko
6,002,210 A 12/1999 Nilssen
6,020,688 A 2/2000 Moisin
6,028,400 A 2/2000 Pol et al.
6,037,720 A 3/2000 Wong et al.
6,038,149 A 3/2000 Hiraoka et al.
6,040,662 A 3/2000 Asayama
6,043,609 A 3/2000 George et al.
6,049,177 A 4/2000 Felper
6,072,282 A 6/2000 Adamson
6,104,146 A 8/2000 Chou et al.
6,108,215 A 8/2000 Kates et al.
6,114,814 A 9/2000 Shannon et al.
6,121,733 A 9/2000 Nilssen
6,127,785 A 10/2000 Williams
6,127,786 A 10/2000 Moisin
6,137,240 A 10/2000 Bogdan
6,150,772 A 11/2000 Crane
6,169,375 B1 1/2001 Moisin
6,181,066 B1 1/2001 Adamson
6,181,083 B1 1/2001 Moisin
6,181,084 B1 1/2001 Lau
6,188,553 B1 2/2001 Moisin
6,198,234 B1 3/2001 Henry
6,198,236 B1 3/2001 O'Neill
6,215,256 B1 4/2001 Ju
6,218,788 B1 4/2001 Chen et al.
6,259,615 B1 7/2001 Lin
6,281,636 B1 8/2001 Okutsu et al.
6,281,638 B1 8/2001 Moisin
6,307,765 B1 10/2001 Choi
6,310,444 B1 10/2001 Chang
6,316,881 B1 11/2001 Shannon et al.
6,320,329 B1 11/2001 Wacyk
6,323,602 B1 11/2001 De Groot et al.
6,344,699 B1 2/2002 Rimmer
6,362,577 B1 3/2002 Ito et al.
6,396,722 B2 5/2002 Lin
6,417,631 B1 7/2002 Chen et al.
6,420,839 B1 7/2002 Chiang et al.
6,433,492 B1 8/2002 Buonavita
6,441,943 B1 8/2002 Roberts et al.
6,445,141 B1 9/2002 Kastner et al.
6,459,215 B1 10/2002 Nerone et al.
6,459,216 B1 10/2002 Tsai
6,469,922 B2 10/2002 Choi
6,472,827 B1 10/2002 Nilssen
6,472,876 B1 10/2002 Notohamiprodjo et al.
6,486,618 B1 11/2002 Li
6,494,587 B1 12/2002 Shaw et al.
6,501,234 B2 12/2002 Lin et al.
6,509,696 B2 1/2003 Bruning et al.
6,515,427 B2 2/2003 Oura et al.
6,515,881 B2 2/2003 Chou et al.
6,522,558 B2 2/2003 Henry
6,531,831 B2 3/2003 Chou et al.
6,534,934 B1 3/2003 Lin et al.
6,559,606 B1 5/2003 Chou et al.
6,570,344 B2 5/2003 Lin
6,628,093 B2 9/2003 Stevens
6,633,138 B2 10/2003 Shannon et al.
6,680,834 B2 1/2004 Williams
6,717,371 B2 4/2004 Klier et al.
6,717,372 B2 4/2004 Lin et al.
6,765,354 B2 7/2004 Klein et al.
6,781,325 B2 8/2004 Lee
6,784,627 B2 8/2004 Suzuki et al.
6,804,129 B2 10/2004 Lin
6,864,867 B2 3/2005 Biebl
6,870,330 B2 3/2005 Choi
6,922,023 B2 7/2005 Hsu et al.
6,930,893 B2 8/2005 Vinciarelli
6,936,975 B2 8/2005 Lin et al.
7,187,139 B2 3/2007 Jin
7,411,358 B2 8/2008 Shimura
7,446,485 B2 11/2008 Huang
7,667,410 B2 * 2/2010 Kim et al. ..... 315/274
2001/0036096 A1 11/2001 Lin
2002/0030451 A1 3/2002 Moisin
2002/0097004 A1 7/2002 Chiang et al.
2002/0135319 A1 9/2002 Bruning et al.
2002/0140538 A1 10/2002 Yer et al.
2002/0145886 A1 10/2002 Stevens
2002/0171376 A1 11/2002 Rust et al.
2002/0180380 A1 12/2002 Lin
2002/0180572 A1 12/2002 Kakehashi et al.
2002/0181260 A1 12/2002 Chou et al.
2002/0195971 A1 12/2002 Qian et al.
2003/0001524 A1 1/2003 Lin et al.
2003/0015974 A1 1/2003 Klier et al.
2003/0080695 A1 5/2003 Ohsawa

| | | | | |
|---|---|---|---|---|
| 2003/0090913 | A1 | 5/2003 | Che-Chen et al. | |
| 2003/0117084 | A1 | 6/2003 | Stack | |
| 2003/0141829 | A1 | 7/2003 | Yu et al. | |
| 2004/0000879 | A1 | 1/2004 | Lee | |
| 2004/0032223 | A1 | 2/2004 | Henry | |
| 2004/0155596 | A1 | 8/2004 | Ushijima et al. | |
| 2004/0257003 | A1 | 12/2004 | Hsieh et al. | |
| 2004/0263092 | A1 | 12/2004 | Liu | |
| 2005/0093471 | A1* | 5/2005 | Jin | 315/177 |
| 2005/0093472 | A1 | 5/2005 | Jin | |
| 2005/0093482 | A1 | 5/2005 | Ball | |
| 2005/0093483 | A1 | 5/2005 | Ball | |
| 2005/0093484 | A1 | 5/2005 | Ball | |
| 2005/0099143 | A1 | 5/2005 | Kohno | |
| 2005/0156539 | A1 | 7/2005 | Ball | |
| 2005/0162098 | A1 | 7/2005 | Ball | |
| 2005/0225261 | A1 | 10/2005 | Jin | |
| 2006/0022612 | A1 | 2/2006 | Henry | |

FOREIGN PATENT DOCUMENTS

| | | | |
|---|---|---|---|
| EP | 0587923 | | 3/1994 |
| EP | 0597661 | | 5/1994 |
| EP | 0647021 | A1 | 9/1994 |
| EP | 0838272 | A2 | 4/1998 |
| EP | 1796440 | A2 | 6/2007 |
| JP | 5-90897 | | 12/1993 |
| JP | 06168791 | A | 6/1994 |
| JP | 06181095 | A | 6/1994 |
| JP | 8-204488 | | 8/1996 |
| JP | 11238589 | A | 8/1999 |
| JP | 11305196 | A | 11/1999 |
| JP | 2000030880 | A | 1/2000 |
| JP | 2002367835 | A | 12/2002 |
| TW | 485701 | | 5/2002 |
| TW | 556860 | | 1/2003 |
| TW | 0554643 | | 9/2003 |
| TW | 200501829 | | 1/2005 |
| WO | WO 94/15444 | | 7/1994 |
| WO | WO 96/38024 | | 11/1996 |

OTHER PUBLICATIONS

Bradley, D.A., "Power Electronics" 2nd Edition; Chapman & Hall, 1995; Chapter 1, pp. 1-38.

Dubey, G. K., "Thyristorised Power Controllers"; Halsted Press, 1986; pp. 74-77.

Supplementary European Search Report for Application No. EP 04794179, dated May 15, 2007.

Examination Report for Application No. EP 04794179, dated Oct. 16, 2007.

Taiwan Examination Report for Application No. 094110958, dated Mar. 20, 2008, 9 pages.

International Search Report and Written Opinion for PCT/US2009/032788.

* cited by examiner

BALANCING ARRANGEMENT WITH REDUCED AMOUNT OF BALANCING TRANSFORMERS

CROSS-REFERENCE TO RELATED APPLICATIONS

This application claims priority from U.S. Provisional Patent Application Ser. No. 61/026,227 filed Feb. 5, 2008, U.S. Provisional Patent Application Ser. No. 61/055,993 filed May 25, 2008 and U.S. Provisional Patent Application Ser. No. 61/114,124 filed Nov. 13, 2008, the entire contents of all of which are incorporated herein by reference. This application is related to co-filed U.S. patent application Ser. No. 12/363,805 entitled "Arrangement Suitable for Driving Floating CCFL Based Backlight" and co-filed U.S. patent application Ser. No. 12/363,806 entitled "Direct Coupled Balancer Drive for Floating Lamp Structure", the entire contents of each of which is incorporated herein by reference.

BACKGROUND OF THE INVENTION

The present invention relates to the field of cold cathode fluorescent lamp based lighting and more particularly to an arrangement in which balancing transformers are supplied at the lamp end associated with the driving transformer.

Fluorescent lamps are used in a number of applications including, without limitation, backlighting of display screens, televisions and monitors. One particular type of fluorescent lamp is a cold cathode fluorescent lamp (CCFL). Such lamps require a high starting voltage (typically on the order of 700 to 1,600 volts) for a short period of time to ionize a gas contained within the lamp tubes and fire or ignite the lamp. This starting voltage may be referred to herein as a strike voltage or striking voltage. After the gas in a CCFL is ionized and the lamp is fired, less voltage is needed to keep the lamp on.

In liquid crystal display (LCD) applications, a backlight is needed to illuminate the screen so as to make a visible display. Backlight systems in LCD or other applications typically include one or more CCFLs and an inverter system to provide both DC to AC power conversion and control of the lamp brightness. Even brightness across the panel and clean operation of inverters with low switching stresses, low EMI, and low switching losses is desirable.

The lamps are typically arranged with their longitudinal axis proceeding horizontally. In general, even brightness involves two dimensions: uniform brightness in the vertical dimension, i.e. among the various lamps; and uniform brightness along the longitudinal axis of each of the various lamps in the horizontal dimension. Brightness uniformity in the vertical dimension is largely dependent on matching the lamp currents, which normally requires a certain type of balancing technique to maintain an even lamp current distribution. U.S. Pat. No. 7,242,147 issued Jul. 10, 2007 to Jin, entitled "Current Sharing Scheme for Multiple CCFL Lamp Operation", the entire contents of which is incorporated herein by reference, is addressed to a ring balancer comprising a plurality of balancing transformers which facilitate current sharing in a multi-lamp backlight system thus providing even lamp current distribution. Advantageously, such a ring balancer may be arranged with a low voltage, high current loop, thereby exhibiting limited leakage to a metal chassis.

Brightness uniformity in the horizontal dimension is impacted by the existence of parasitic capacitance between the CCFLs and the chassis. As a result of the parasitic capacitance, leakage current exists along the length of the lamps and such leakage further results in diminishing brightness along the lamps' longitudinal axis towards the cold end in a single ended drive architecture. The term single ended drive architecture refers to a backlight arrangement in which the high voltage drive power is applied from only one side of the lamp, which is usually called the 'hot' end, and the other side of the lamp is normally at ground potential and referred as the 'cold' end.

What is desired, and not provided by the prior art, is a backlighting arrangement that can preferably provide relatively even luminance across each lamp in the system, preferably with only one inverter circuit, and further preferably provide balance for currents between lamps in the system via balancing transformers located at the lamp end associated with the driving transformer.

SUMMARY OF THE INVENTION

Accordingly, it is a principal object of the present invention to overcome at least some of the disadvantages of prior art. This is provided in certain embodiments by a backlighting arrangement in which luminaires constituted of serially connected lamp pairs, or a U-shaped lamp, are provided. One end of each luminaire is coupled to an output of a driving transformer, or other AC source, and a second end of each luminaire is coupled to the primary winding of a balancing transformer. The secondary windings of the balancing transformers are connected in a single closed loop, and arranged to be in-phase.

In one embodiment, an additional balancing transformer is provided, whose primary winding is connected between the lamps of each of the lamp pairs. In such an embodiment, the secondary windings of all of the balancing transformers are connected in a single closed loop, and arranged to be in-phase. Such an arrangement allows for a floating lamp structure, in which energy is provided to the ends of the lamps removed from the driving transformer by the closed loop.

In one embodiment, an odd number of luminaires are provided. In another embodiment, a total of 4 luminaires are provided, and a single balancing transformer is provided, wherein the primary winding of the single balancing transformer is associated with a first two of the luminaires and the secondary winding is associated with a second two of the luminaires.

Certain embodiments provide for a backlighting arrangement comprising: a driving transformer; at least one balancing transformer; and a plurality of luminaires, each of the plurality of luminaires constituted of one of a pair of serially connected linear lamps and a U-shaped lamp, a first end of each of the plurality of luminaires connected to a high voltage lead of the driving transformer and a second end of each of the plurality of luminaires connected to a unique end of a winding of the at least one balancing transformer, wherein each pair of the luminaires is associated with a particular winding of one of the at least one balancing transformers, a first luminaire of the pair connected to a first end of the particular winding and a second luminaire of the pair connected to second end of the particular winding, the second end different from the first end, and wherein the first end and the second end of each of the luminaires is in physical proximity of the driving transformer and the at least one balancing transformer, the constituent lamps of the luminaires arranged in parallel and generally extending axially away from the proximity of the driving transformer.

In one embodiment, the plurality of luminaires is constituted of 4 luminaires, a first two of the luminaires connected to each end of a primary winding of a single balancing transformer and a second two of the luminaires connected to each end of a secondary winding of the single balancing transformer. In another embodiment, the backlighting arrangement further comprises at least two balancing transformers, wherein the particular winding of the balancing transformers is a primary winding, each of the balancing transformers comprising a secondary winding magnetically coupled to the primary winding, the secondary windings of the balancing transformers serially connected in a closed in-phase loop.

In one further embodiment, the backlighting arrangement further comprises an odd number of luminaires wherein one of the luminaires does not participate in any of the pairs, the second end of the primary winding of the balancing transformer associated with the not participating luminaire connected to a high voltage lead of the driving transformer. In another further embodiment, the backlighting arrangement further comprises an odd number of luminaires wherein one of the luminaires does not participate in any of the pairs, and wherein the driving transformer exhibits a pair of secondary windings, a first end of each of the secondary windings being connected together, and wherein the high voltage leads of the driving transformer are associated with a second end of each of the secondary windings, the second end of the primary winding of the balancing transformer associated with the not participating luminaire connected to the first end of the secondary windings of the driving transformer.

In another further embodiment, each of the luminaires is constituted of the pair of serially connected linear lamps, and further comprising an additional balancing transformer associated with each of the luminaires, a primary winding of the associated additional balancing transformer connected between the serially connected linear lamps, a secondary winding of each of the additional balancing transformers being serially connected in the closed in-phase loop. In yet another further embodiment, the backlighting arrangement further comprises a current sensing arrangement is provided within the serially connected closed in-phase loop.

In one embodiment, the luminaires are arranged so that adjacent ends of the luminaires exhibit a uniform voltage difference there between. In another embodiment, the driving transformer exhibits a pair of secondary windings, a first end of each of the secondary windings being connected to a common point via a unique sense resistor, and wherein the high voltage leads of the driving transformer are associated with a second end of each of the secondary windings. In yet another embodiment, the driving transformer exhibits a pair of secondary windings, a first end of each of the secondary windings being connected together, and wherein the high voltage leads of the driving transformer are associated with a second end of each of the secondary windings.

Certain embodiments provide for a backlighting arrangement comprising: an alternating current voltage source, comprising a first and a second voltage lead; at least one balancing transformer; and a plurality of luminaires, each of the plurality of luminaires constituted of one of a pair of serially connected linear lamps and a U-shaped lamp, a first end of each of the plurality of luminaires connected to one of the first and second voltage leads and a second end of each of the plurality of luminaires connected to a unique end of a winding of the at least one balancing transformer, wherein each pair of the luminaires is associated with a particular winding of one of the at least one balancing transformers, a first luminaire of the pair connected to a first end of the particular winding and a second luminaire of the pair connected to second end of the particular winding, the second end different from the first end, and wherein the first end and the second end of each of the luminaires are generally spatially aligned to define a first plane, the constituent lamps of the luminaires arranged in parallel and generally defining a second plane orthogonal to the first plane.

In one embodiment, the plurality of luminaires is constituted of 4 luminaires, a first two of the luminaires connected to each end of a primary winding of a single balancing transformer and a second two of the luminaires connected to each end of a secondary winding of the single balancing transformer. In another embodiment, the backlighting arrangement further comprises at least two balancing transformers, wherein the particular winding of the balancing transformers is a primary winding, each of the balancing transformers comprising a secondary winding magnetically coupled to the primary winding, the secondary windings of the balancing transformers serially connected in a closed in-phase loop.

In one further embodiment, the backlighting arrangement comprises an odd number of luminaires wherein one of the luminaires does not participate in any of the pairs, the second end of the primary winding of the balancing transformer associated with the not participating luminaire connected to one of the first and second voltage leads. In another further embodiment, the backlighting arrangement comprises an odd number of luminaires wherein one of the luminaires does not participate in any of the pairs, and wherein the alternating current voltage source comprises a driving transformer exhibiting a pair of secondary windings, a first end of each of the secondary windings being connected together, and wherein the high voltage leads of the driving transformer are associated with a second end of each of the secondary windings, the second end of the primary winding of the balancing transformer associated with the not participating luminaire connected to the first end of the secondary windings of the driving transformer.

In one embodiment, each of the luminaires is constituted of the pair of serially connected linear lamps, and further comprising an additional balancing transformer associated with each of the luminaires, a primary winding of the associated additional balancing transformer connected between the serially connected linear lamps, a secondary winding of each of the additional balancing transformers being serially connected in the closed in-phase loop. In another embodiment, a current sensing arrangement is provided within the serially connected closed in-phase loop.

In one embodiment, the luminaires are arranged so that adjacent ends of the luminaires exhibit a uniform voltage difference there between. In another embodiment, the alternating current voltage source comprises a driving transformer exhibiting a pair of secondary windings, a first end of each of the secondary windings being connected to a common point via a unique sense resistor, and wherein the voltage leads of the driving transformer are associated with a second end of each of the secondary windings.

In one embodiment, the alternating current voltage source comprises a driving transformer exhibiting a pair of secondary windings, a first end of each of the secondary windings being connected together, and wherein the voltage leads of the driving transformer are associated with a second end of each of the secondary windings.

Certain embodiments provide for a method of backlighting comprising: receiving an alternating current voltage; providing at least one balancing transformer; providing a plurality of luminaires, each of the plurality of luminaires constituted of one of a pair of serially connected linear lamps and a U-shaped lamp; connecting a first end of each of the provided plurality of luminaires to one polarity of the received alternating current voltage; connecting a second end of each of the provided plurality of luminaires to a unique end of a winding of the at least one balancing transformer, wherein each pair of the luminaires is associated with a particular winding of one of the at least one balancing transformers, a first luminaire of the pair connected to a first end of the particular winding and a second luminaire of the pair connected to second end of the particular winding, the second end different from the first end; and spatially arranging the provided luminaires so that the first end and the second end of each of the luminaires generally define a first plane, the constituent lamps of the luminaires generally defining a second plane orthogonal to the first plane.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings:

FIG. 5 illustrates a high level block diagram of an embodiment of a backlighting arrangement comprising a plurality of luminaires each constituted of a pair of linear lamps, with a single balancing transformer for each pair of luminaires, wherein the lamps are arranged such that adjacent ends of the luminaires exhibit a uniform voltage difference there between;

DETAILED DESCRIPTION OF PREFERRED EMBODIMENTS

Figure 1:
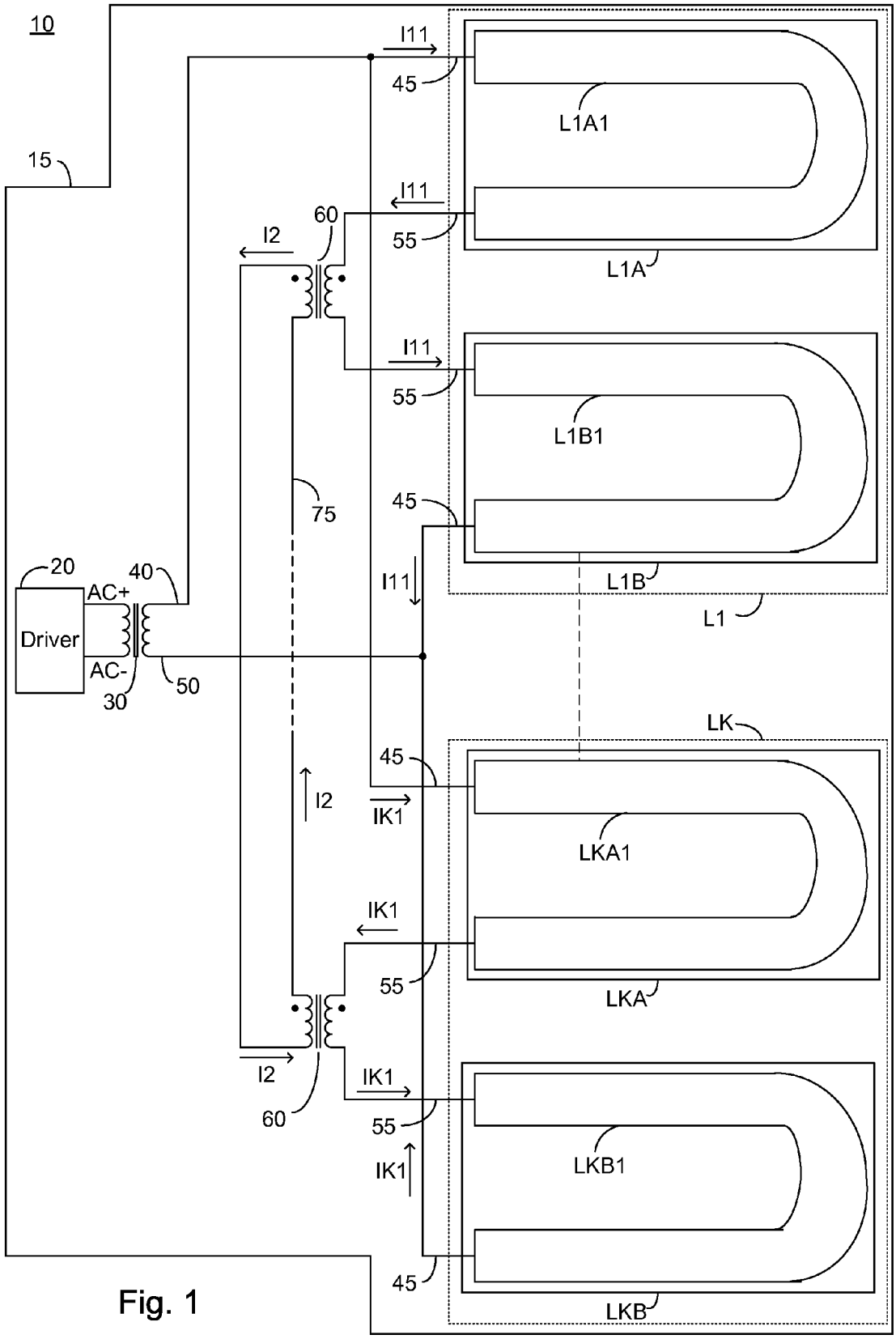
FIG. 1 illustrates a high level block diagram of an embodiment of a backlighting arrangement comprising a plurality of luminaires each constituted of a U-shaped lamp, with a single balancing transformer for each pair of luminaires.

Certain of the present embodiments enable a backlighting arrangement in which luminaires constituted of serially connected lamp pairs, or a U-shaped lamp, are provided. One end of each luminaire is coupled to an output of a driving transformer, or other AC source, and a second end of each luminaire is coupled to the primary winding of a balancing transformer. The secondary windings of the balancing transformers are connected in a single closed loop, and arranged to be in-phase.

In one embodiment, an additional balancing transformer is provided, whose primary winding is connected between the lamps of each of the lamp pairs. In such an embodiment, the second windings of all of the balancing transformers are connected in a single closed loop, and arranged to be in-phase. Such an arrangement allows for a floating lamp structure, in which energy is provided to the ends of the lamps removed from the driving transformer by the closed loop.

In one embodiment, an odd number of luminaries are provided. In another embodiment, a total of 4 luminaires are provided, and a single balancing transformer is provided, wherein the primary winding is associated with a first two of the luminaires and the secondary winding is associated with a second two of the luminaires.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 illustrates a high level block diagram of an embodiment of a backlighting arrangement 10 comprising a chassis 15, a plurality of pairs of luminaires L1 . . . LK, a driver 20, a driving transformer 30, and a plurality of balancing transformers 60. Each of the plurality of pairs of luminaires L1 . . . LK comprises a first luminaire L1A . . . LKA, respectively, and a second luminaire L1B . . . LKB, respectively. Each of first and second luminaires L1A, L1B . . . LKA, LKB is constituted of a U-shaped lamp L1A1, L1B1 . . . LKA1, LKB1, respectively. A first end of each of U-shaped lamps L1A1, L1B1 . . . LKA1, LKB1 constitutes a hot end 45 of the respective one of first and second luminaires L1A, L1B . . . LKA, LKB, and a second end of each of U-shaped lamps L1A1, L1B1 . . . LKA1, LKB1 constitutes a cold end 55 of the respective one of first and second luminaires L1A, L1B . . . LKA, LKB. Driving transformer 30 exhibits a first output 40 and a second output 50.

Driver 20, driving transformer 30, plurality of balancing transformers 60, and plurality of pairs of luminaires L1 . . . LK, are disposed within chassis 15. Each pair of luminaires L1 . . . LK has associated therewith a single balancing transformer 60. The first and second end of each of U-shaped lamps L1A1, L1B1 . . . LKA1, LKB1 are in physical proximity of driving transformer 30, e.g., on the same side of chassis 15 as driving transformer 30, in physical proximity of balancing transformers 60, and preferably generally define a first plane. Each of U-shaped lamps L1A1, L1B1 . . . LKA1, LKB1 generally extend axially away from the proximity of driving transformer 30, and generally define a second plane preferably orthogonal to the plane defined by first and second ends of U-shaped lamps L1A1, L1B1 . . . LKA1, LKB1. The outputs of driver 20 are connected to both ends of the primary winding of driving transformer 30. In one embodiment driver 20 is constituted of a CCFL controller and the associated switches in either a full bridge or half bridge configuration.

A first end of the secondary winding of driving transformer 30, denoted first output 40, is connected to hot end 45 of each of first luminaires L1A . . . LKA. A second end of the secondary winding of driving transformer 30, denoted second output 50, is connected to hot end 45 of each of second luminaires L1B . . . LKB. A first end of the primary winding of each balancing transformer 60 is connected to cold end 55 of the respective associated first luminaire L1A . . . LKA, and a second end of the primary winding of each balancing transformer 60 is connected to cold end 55 of the respective associated second luminaire L1B . . . LKB. The secondary windings of balancing transformers 60 are connected in a closed loop 75, in which the polarity of the secondary windings are arranged so that voltages induced in the secondary windings are in phase and add within closed loop 75.

In operation, driver 20, which in one embodiment comprises a direct drive backlight driver as described in U.S. Pat. No. 5,930,121 issued Jul. 27, 1999 to Henry, entitled "Direct Drive Backlight System", the entire contents of which is incorporated herein by reference, provides a differential AC source via driving transformer 30. In one further embodiment the secondary of driving transformer 30 is allowed to float. For simplicity, we designate first output 40 as AC+ and second output 50 as AC−, which is appropriate for ½ the drive cycle. During the second half of the drive cycle, polarity is reversed and the direction of current flow is reversed.

Currents I11-IK1 are developed through the secondary winding of driving transformer 30, responsive to AC+ at first output 40, and driven through the respective first luminaires L1A . . . LKA via the respective hot ends 45. Currents I11-IK1 exit cold end 55 of each of first luminaires L1A . . . LKA, respectively, and flow via the primary winding of the associated balancing transformer 60 into cold end 55 of the associated second luminaires L1B . . . LKB. Currents I11-IK1 then exit hot end 45 of the associated second luminaires L1B . . . LKB, respectively, and return to driving transformer 30 at second output 50. Current I2 is developed in the secondary of each of balancing transformers 60, responsive to the respective currents I11-IK1. As the secondary windings of balancing transformers 60 are connected in closed loop 75, current I2 is the same for the secondary of each balancing transformer 60. As described above each of pair of luminaires L1 . . . LK is connected to a balancing transformer 60, therefore currents I11-IK1 flowing through each of luminaires L1A, L1B . . . LKA, LKB are the same. Thus, equal current is maintained through all of luminaires L1A, L1B . . . LKA, LKB, by providing only one balancing transformer 60 for each pair of luminaires L1 . . . LK.

In one embodiment, an excess lamp current, typically associated with a short circuit, can be sensed by inserting a sense resistor in closed loop 75, as will be described below in relation to FIG. 5.

Figure 2:
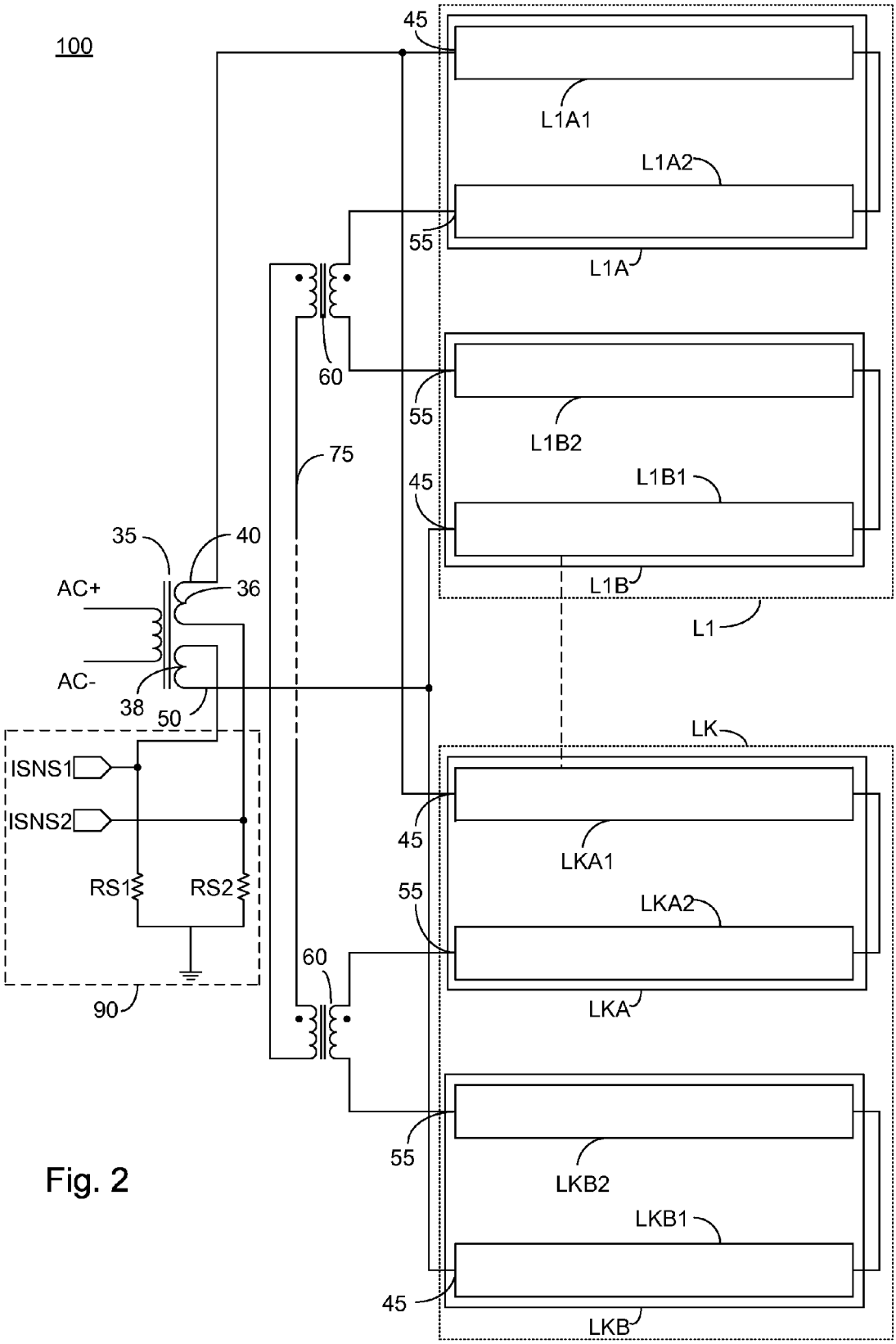
FIG. 2 illustrates a high level block diagram of an embodiment of a backlighting arrangement comprising a plurality of luminaires each constituted of a pair of linear lamps, with a single balancing transformer for each pair of luminaires, wherein the driving transformer exhibits a pair of secondary windings, one end of each winding being coupled to a common point.

FIG. 2 illustrates a high level block diagram of an embodiment of a backlighting arrangement 100 comprising a plurality of pairs of luminaires L1 . . . LK, a driving transformer 35 exhibiting a pair of secondary windings 36 and 38, a plurality of balancing transformers 60, and a current sensing system 90. Each of the plurality of pairs of luminaires L1 . . . LK comprises a first luminaire L1A . . . LKA, respectively, and a second luminaire L1B . . . LKB, respectively. Each of first and second luminaires L1A, L1B . . . LKA, LKB comprises a first linear lamp L1A1, L1B1 . . . LKA1, LKB1, respectively, and a second linear lamp L1A2, L1B2 . . . LKA2, LKB2, respectively. A first end of each of first linear lamps L1A1, L1B1 . . . LKA1, LKB1 constitutes a hot end 45 of the respective one of first and second luminaires L1A, L1B . . . LKA, LKB, and a first end of each of second linear lamps L1A2, L1B2 . . . LKA2, LKB2 constitutes a cold end 55 of the respective one of first and second luminaires L1A, L1B . . . LKA, LKB. Current sensing system 90 comprises a pair of current sense leads ISNS1, ISNS2 and a pair of sense resistors RS1, RS2.

Each pair of luminaires L1 . . . LK has associated therewith a single balancing transformer 60. Hot ends 45 and cold ends 55 of each of first and second luminaires L1A, L1B . . . LKA, LKB are in physical proximity of driving transformer 30 transformer 35, e.g. on the same side of the chassis (not shown) as driving transformer 35, in physical proximity of balancing transformers 60, and preferably generally define a first plane. First and second linear lamps UAL L1A2, L1B1, L1B2 . . . LKA1, LKB1, LKA2, LKB2 are arranged in parallel, generally extend axially away from the proximity of driving transformer 35 and generally define a second plane preferably orthogonal to the plane defined by hot ends 45 and cold ends 55. A second end of each of first lamps L1A1, L1B1 . . . LKA1, LKB1, is connected to a second end of respective second lamps L1A2, L1B2 . . . LKA2, LKB2. It is to be noted that hot ends 45 and cold ends 55 are stacked vertically appearing in alternating pairs.

A first end of secondary winding 36 of driving transformer 35, denoted first output 40, is connected to hot end 45 of each of first luminaires L1A . . . LKA. A first end of secondary winding 38 of driving transformer 35, denoted second output 50, is connected to hot end 45 of each of second luminaires L1B . . . LKB. A first end of the primary winding of each balancing transformer 60 is connected to cold end 55 of the respective associated first luminaire L1A . . . LKA, and a second end of the primary winding of each balancing transformer 60 is connected to cold end 55 of the respective associated second luminaire L1B . . . LKB. The secondary windings of balancing transformers 60 are connected in a closed loop 75, in which the polarity of the secondary windings are arranged so that voltages induced in the secondary windings are in phase and add within closed loop 75. A second end of secondary winding 36 of driving transformer 35 is connected to current sense lead ISNS2 and to a first end of sense resistor RS2. A second end of second secondary winding 38 of driving transformer 35 is connected to current sense lead ISNS1 and to a first end of sense resistor RS1. A second end of each of sense resistors RS1 and RS2 are connected to a common point, which in one embodiment is ground.

In operation backlighting arrangement 100 operates in all respects similar to the operation of backlighting arrangement 10 of FIG. 1. Advantageously, any current imbalance between first output 40 and second output 50 is sensed responsive to the differential voltage appearing between current sensing outputs ISNS1 and ISNS2 of current sensing system 90, which are in one embodiment both fed to a CCFL controller (not shown) for corrective action or shut down.

Figure 3:
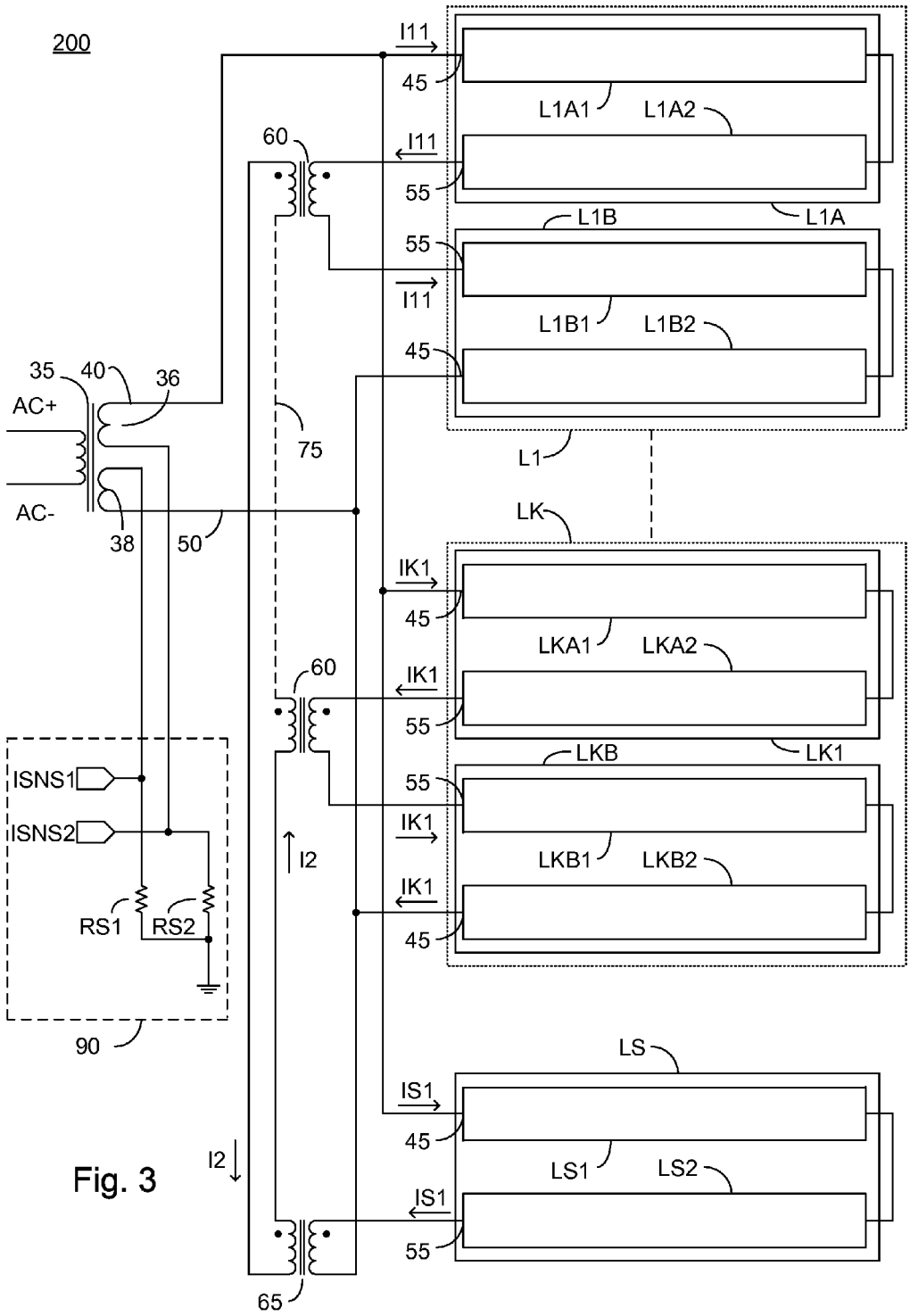
FIG. 3 illustrates a high level block diagram of an embodiment of a backlighting arrangement comprising an odd number of luminaires each constituted of a pair of linear lamps, with a single balancing transformer for each pair of luminaires, and a balancing transformer for the odd luminaire.

FIG. 3 illustrates a high level block diagram of an embodiment of a backlighting arrangement 200 comprising a plurality of pairs of luminaires L1 . . . LK, a luminaire LS, a driving transformer 35 exhibiting a pair of secondary windings 36 and 38, a plurality of balancing transformers 60, a balancing transformer 65, and a current sensing system 90. Each of the plurality of pairs of luminaires L1 . . . LK comprises a first luminaire L1A . . . LKA, respectively, and a second luminaire L1B . . . LKB, respectively. Each of first and second luminaires L1A, L1B . . . LKA, LKB comprises a first linear lamp L1A1, L1B1 . . . LKA1, LKB1, respectively, and a second linear lamp L1A2, L1B2 . . . LKA2, LKB2, respectively. Luminaire LS comprises a first linear lamp LS1 and a second linear lamp LS2. A first end of each of first linear lamps UAL L1B1 . . . LKA1, LKB1, LS1 constitutes a hot end 45 of the respective one of first and second luminaires L1A, L1B . . . LKA, LKB, LS and a first end of each of second linear lamps L1A2, L1B2 . . . LKA2, LKB2, LS2 constitutes a cold end 55 of the respective one of first and second luminaires L1A, L1B . . . LKA, LKB, LS. Current sensing system 90 comprises a pair of current sense leads ISNS1, ISNS2 and a pair of sense resistors RS1, RS2.

Each pair of luminaires L1 . . . LK has associated therewith a single balancing transformer 60, and luminaire LS has associated therewith a single balancing transformer 65. Hot ends 45 and cold ends 55 of each of first and second luminaires L1A, L1B . . . LKA, LKB and luminaire LS, are in physical proximity of driving transformer 35, e.g. on the same side of the chassis (not shown) as driving transformer 35, in physical proximity of balancing transformers 60 and 65, and preferably generally define a first plane. First and second linear lamps UAL L1A2, L1B1, L1B2 . . . LKA1, LKB1, LKA2, LKB2, LS1 and LS2 are arranged in parallel, generally extend axially away from the proximity of driving transformer 35 and generally define a second plane preferably orthogonal to the plane defined by hot ends 45 and cold ends 55. It is to be noted that hot ends 45 and cold ends 55 are stacked vertically appearing in alternating pairs. A second end each of first lamps UAL L1B1 . . . LKA1, LKB1, is connected to a second end of respective second lamp L1A2, L1B2 . . . LKA2, LKB2. A second end of first lamp LS1 is connected to a second end of lamp LS2.

A first end of secondary winding 36 of driving transformer 35, denoted first output 40, is connected to hot end 45 of each of first luminaires L1A . . . LKA and luminaire LS. A first end of secondary winding 38 of driving transformer 35, denoted second output 50, is connected to hot end 45 of each of second luminaires L1B . . . LKB and to a first end of the primary winding of balancing transformer 65. A first end of the primary winding of each balancing transformer 60 is connected to cold end 55 of the respective associated first luminaire L1A . . . LKA, and a second end of the primary winding of each balancing transformer 60 is connected to cold end 55 of the respective associated second luminaire L1B . . . LKB. A second end of the primary winding of balancing transformer 65 is connected to cold end 55 of luminaire LS, i.e. to the first end of linear lamp LS2. The secondary windings of each of balancing transformers 60 and balancing transformer 65 are connected in a closed loop 75, in which the polarity of the secondary windings are arranged so that voltages induced in the secondary windings are in phase and add within closed loop 75. A second end of secondary winding 36 of driving transformer 35 is connected to current sense lead ISNS2 and to a first end of sense resistor RS2. A second end of second secondary winding 38 of driving transformer 35 is connected to current sense lead ISNS1 and to a first end of sense resistor RS1. A second end of each of sense resistors RS1 and RS2 are connected to a common point, which in one embodiment is ground.

In operation backlighting arrangement 200 operates in all respects similar to the operation of backlighting arrangement 100, with the addition of luminaire LS. Current IS1 flowing through luminaire LS is controlled responsive to the turns ratio of balancing transformer 65 and current I2 flowing through closed loop 75. Balancing transformer 65 must produce a voltage drop equivalent to two linear lamps, and thus power dissipated across balancing transformer 65 will be higher than the power dissipation across any of balancing transformers 60. In one embodiment, the turns ratio of balancing transformer 65 is the same as the turns ratio of each of balancing transformers 60. The identical turns ratio essentially maintains lamp current IS1 flowing through luminaire LS, and particularly through first linear lamp LS1 and second linear lamp LS2, equal to respective currents I11-IK1 flowing through each of first and second luminaires L1A, L1B . . . LKA, LKB, particularly first linear lamp L1A1, L1B1 . . . LKA1, LKB1 and second linear lamp L1A2, L1B2 . . . LKA2, LKB2, respectively, according to the principle of the balancer operation. A voltage equivalent to two linear lamp voltage drops is automatically developed in the primary winding of 65 so as to maintain the lamp current balancing. The primary and secondary winding turns of balancing transformer 65 can be made greater than the respective number of turns of balancing transformer 60 while maintaining the same turns ratio. Increasing the respective number of turns while maintaining the same turns ratio reduces the power dissipation across balancing transformer 65 by maintaining a low core flux density, since core flux density is proportional to winding voltage and inversely proportional to the number of turns.

Figure 4:
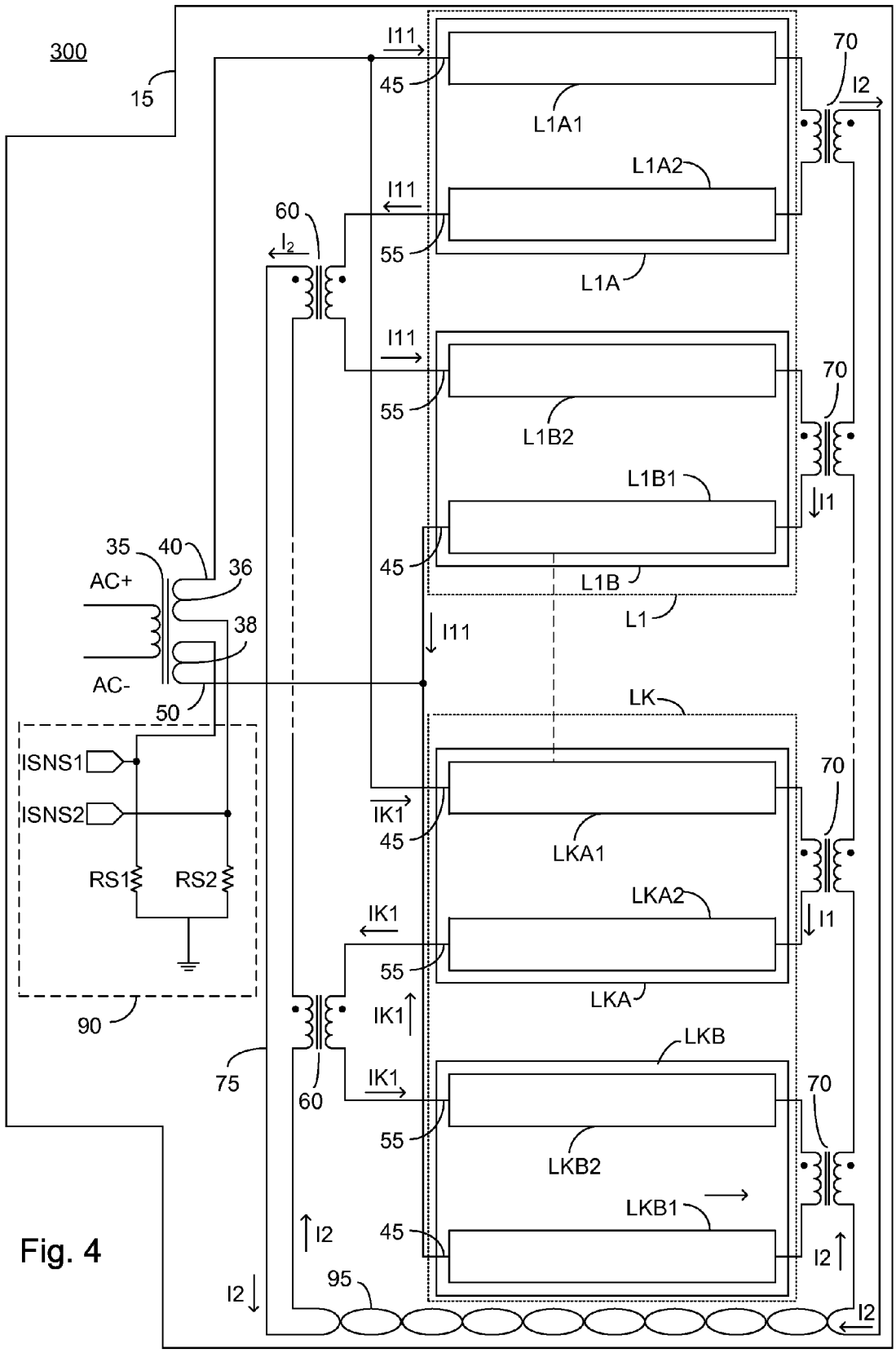
FIG. 4 illustrates a high level block diagram of an embodiment of a backlighting arrangement comprising a plurality of luminaires each constituted of a pair of linear lamps, with a single balancing transformer for each pair of luminaires, wherein an additional balancing transformer is provided for each luminaire connected between the constituent linear lamps.

FIG. 4 illustrates a high level block diagram of an embodiment of a backlighting arrangement 300 comprising a plurality of pairs of luminaires L1 . . . LK, a driving transformer 35 exhibiting a pair of secondary windings 36 and 38, a plurality of first balancing transformers 60, a plurality of second balancing transformers 70, and a current sensing system 90, all disposed within a chassis 15. Each of the plurality of pairs of luminaires L1 . . . LK comprises a first luminaire L1A . . . LKA, respectively, and a second luminaire L1B . . . LKB, respectively. Each of first and second luminaires L1A, L1B . . . LKA, LKB comprises a first linear lamp L1A1, L1B1 . . . LKA1, LKB1, respectively, and a second linear lamp L1A2, L1B2 . . . LKA2, LKB2, respectively. A first end of each of first linear lamps L1A1, L1B1 . . . LKA1, LKB1 constitutes a hot end 45 of the respective one of first and second luminaires L1A, L1B . . . LKA, LKB, and a first end of each of second lamps L1A2, L1B2 . . . LKA2, LKB2 constitutes a cold end 55 of the respective one of first and second luminaires L1A, L1B . . . LKA, LKB. Current sensing system 90 comprises a pair of current sense leads ISNS1, ISNS2 and a pair of sense resistors RS1, RS2.

Each pair of luminaires L1 . . . LK has associated therewith a single balancing transformer 60. Each of first and second luminaires L1A, L1B, LKA, LKB has associated therewith a second additional balancing transformer 70. Hot ends 45 and cold ends 55 of each of first and second luminaires L1A, L1B . . . LKA, LKB are in physical proximity of driving transformer 35, in physical proximity of balancing transformers 60, and preferably generally define a first plane. First and second linear lamps L1A1, L1A2, L1B1, L1B2 . . . LKA1, LKB1, LKA2, LKB2 are arranged in parallel, generally extend axially away from the proximity of driving transformer 35 and generally define a second plane preferably orthogonal to the plane defined by hot ends 45 and cold ends 55. It is to be noted that hot ends 45 and cold ends 55 are stacked vertically within chassis 15 appearing in alternating pairs. A second end each of first lamps L1A1, L1B1 . . . LKA1, LKB1, is connected via a primary winding of a respective additional balancing transformer 70 to a second end of respective second lamp L1A2, L1B2 . . . LKA2, LKB2.

A first end of secondary winding 36 of driving transformer 35, denoted first output 40, is connected to hot end 45 of each first luminaires L1A . . . LKA. A first end of secondary winding 38 of driving transformer 35, denoted second output 50, is connected to hot end 45 of each of second luminaires L1B . . . LKB. A first end of the primary winding of each first balancing transformer 60 is connected to cold end 55 of each of the respective associated first luminaire L1A . . . LKA, and a second end of the primary winding of each first balancing transformer 60 is connected to cold end 55 of each of the respective associated second luminaire L1B . . . LKB. The secondary windings of first balancing transformers 60 and second balancing transformers 70 are connected in a closed loop 75, in which the polarity of the secondary windings are arranged so that voltages induced in the secondary windings are in phase and add within the closed loop. Preferably a single twisted wire pair 95 is arranged to connect the portion of closed loop 75 associated with second balancing transformers 70 with the portion of closed loop 75 associated with first balancing transformers 60. Thus, a balanced current I2 is exhibited flowing in each direction of twisted wire pair 95 as it traverses the length of chassis 15 reducing any electromagnetic interference. A second end of secondary winding 36 of driving transformer 35 is connected to current sense lead ISNS2 and to a first end of sense resistor RS2. A second end of second secondary winding 38 of driving transformer 35 is connected to current sense lead ISNS1 and to a first end of sense resistor RS1. A second end of each of sense resistors RS1 and RS2 are connected to a common point, which in one embodiment is ground.

In operation, power is output from driving transformer 35 as described above in relation to transformer 30 of FIG. 1. Any current imbalance between first output 40 and second output 50 is sensed responsive to the differential voltage appearing between current sensing outputs ISNS1 and ISNS2 of current sensing system 90, which are in one embodiment both fed to a CCFL controller (not shown) for corrective action or shut down. For simplicity, we designate first output 40 as AC+ and second output 50 as AC−, which is appropriate for ½ the drive cycle. During the second half of the drive cycle, polarity is reversed and the direction of current flow is reversed.

Currents I11-IK1 are developed through the secondary winding of driving transformer 35, responsive to AC+ at first output 40, and driven through the respective first luminaires L1A . . . LKA via the respective hot ends 45. Currents I11-IK1 exit cold end 55 of each of first luminaires L1A . . . LKA, respectively, and flow via the primary winding of the associated balancing transformer 60 into cold end 55 of the associated second luminaires L1B . . . LKB. Currents I11-IK1 then exit hot end 45 of the associated second luminaires L1B . . . LKB, respectively, and return to driving transformer 35 at second output 50. Current I2 is developed in the secondary of each of first balancing transformers 60, responsive to I11-IK1. As the secondary windings of first balancing transformers 60 and second balancing transformers 70 form closed loop 75, current I2 is the same at each balancing transformer 60, 70. As described above, each of first and second luminaires L1A, L1B . . . LKA, LKB is connected to a balancing transformer 60, 70, therefore the current flowing through each of first and second lamps L1A1, L1A2, L1B1, L1B2 . . . LKA1, LKA2, LKB1, LKB2 will be the same since the current flowing throughout closed loop 75 is equal.

In long lamps, due to capacitive leakage along the length of the lamp, even luminance across the lamp is usually not achieved. In the above embodiment each end of each linear lamp L1A1, L1A2, L1B1, L1B2 . . . LKA1, LKB1, LKA2, LKB2 is connected to one of driving transformer 35, a first balancing transformer 60, and a second balancing transformer 70, thereby ensuring drive energy at each of linear lamp L1A1, L1A2, L1B1, L1B2 . . . LKA1, LKB1, LKA2, LKB2, and as a result even luminance across each lamp. Advantageously, the energy coupled through the balancer secondary winding appears as low voltage and high current thus limiting any leakage to the chassis.

Figure 5:
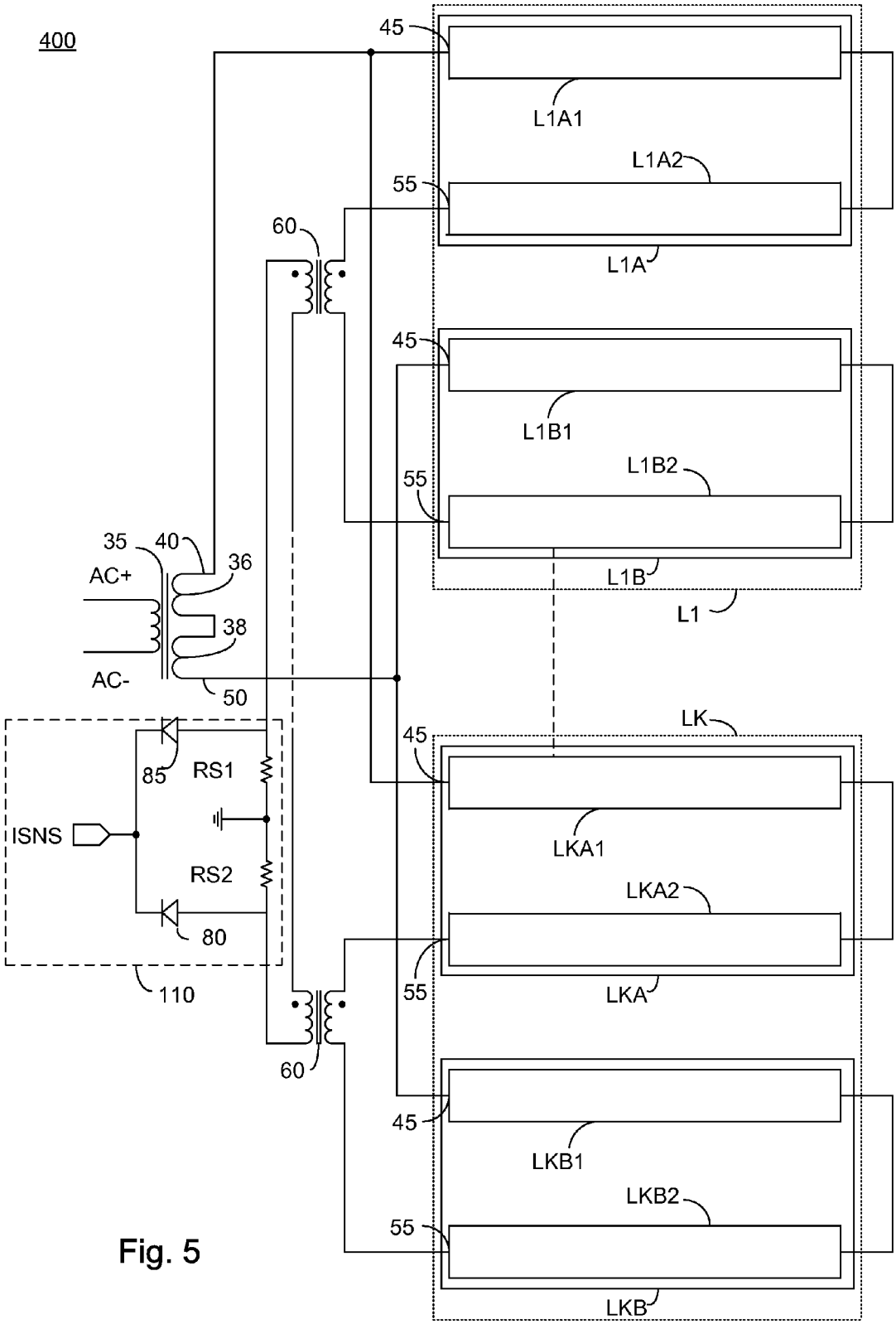

FIG. 5 illustrates a high level block diagram of an embodiment of a backlighting arrangement 400 comprising a plurality of pairs of luminaires L1 . . . LK, a driving transformer 35 exhibiting a pair of secondary windings 36 and 38, a plurality of balancing transformers 60, and a current sensing system 110. Each of the plurality of pairs of luminaires L1 . . . LK comprises a first luminaire L1A . . . LKA, respectively, and a second luminaire L1B . . . LKB, respectively. Each of first and second luminaires L1A, L1B . . . LKA, LKB comprises a first linear lamp UAL L1B1 . . . LKA1, LKB1, respectively, and a second linear lamp L1A2, L1B2 . . . LKA2, LKB2, respectively. A first end of each of first linear lamps UAL L1B1 . . . LKA1, LKB1 constitutes a hot end 45 of the respective one of first and second luminaires L1A, L1B . . . LKA, LKB, and a first end of each of second linear lamps L1A2, L1B2 . . . LKA2, LKB2 constitutes a cold end 55 of the respective one of first and second luminaires L1A, L1B . . . LKA, LKB. Driving transformer 35 exhibits a first and second secondary winding. Current sensing system 110 comprises a current sense lead ISNS, a pair of diodes 80, 85, and a pair of sense resistors RS1, RS2.

Each pair of luminaires L1 . . . LK has associated therewith a single balancing transformer 60. Hot ends 45 and cold ends 55 of each of first and second luminaires L1A, L1B . . . LKA, LKB are in physical proximity of driving transformer e.g. on the same side of the chassis (not shown) as driving transformer 35, in physical proximity of balancing transformers 60, and preferably generally define a first plane. First and second linear lamps L1A1, L1A2, L1B1, L1B2 . . . LKA1, LKB1, LKA2, LKB2 are arranged in parallel, generally extend axially away from the proximity of driving transformer 35 and generally define a second plane preferably orthogonal to the plane defined by hot ends 45 and cold ends 55. Each second lamp of first luminaire L1A2 . . . LKA2 is adjacent to the first lamp of respective second luminaire L1B1 . . . LKB1. A second end of each of first lamps L1A1, L1B1 . . . LKA1, LKB1, is connected to a second end of respective second lamp L1A2, L1B2 . . . LKA2, LKB2. It is to be noted that hot ends 45 and cold ends 55 are stacked vertically appearing alternately.

A first end of secondary winding 36 of driving transformer 35, denoted first output 40, is connected to hot end 45 of each of first luminaires L1A . . . LKA. A first end of second secondary winding 38 of driving transformer 35, denoted second output 50, is connected to hot end 45 of each of second luminaires L1B . . . LKB. A second end of secondary winding 36 of driving transformer 35 is connected to a second end of second secondary winding 38 of driving transformer 35. A first end of the primary winding of each balancing transformer 60 is connected to cold end 55 of the respective associated first luminaire L1A . . . LKA, and a second end of the primary winding of each balancing transformer 60 is connected to cold end 55 of the respective associated second luminaire L1B . . . LKB. The secondary windings of the balancing transformers 60 are connected in a closed loop 75, in which the polarity of the secondary windings are arranged so that voltages induced in the secondary windings are in phase and add within the closed loop. Current sensing system 110 is placed within closed loop 75, with a first end of the secondary winding of one of balancing transformers 60 connected to a first end of sense resistor RS1 and the anode of diode 85 and a first end of the secondary winding of a second one of the balancing transformer 60 connected to the anode of diode 80 and a first end of sense resistor RS2. The cathode of diode 85 is connected to current sense lead ISNS and the cathode of diode 80. A second end of sense resistor RS1 is connected to a second end of sense resistor RS2 and a common point. In one embodiment the common point is ground.

In operation lighting arrangement 400 operates in all respects similar to the operation of lighting arrangement 100, with current I2 being sensed in the balancer secondary winding loop. Current I2 flowing through sense resistors RS1, RS2 is proportional to lamp current I1 according to the primary to secondary turns ratio of balancing transformers 60.

Advantageously, because cold end 55 of each of first luminaires L1A . . . LKA is adjacent to a hot end 45 of a respective one of second luminaires L1B . . . LKB, the voltage drop between each adjacent lamp terminal is equal, thereby achieving improved brightness distribution. In one non-limiting example, driving transformer 35 outputs V volts and the voltage drop across each of linear lamps L1A1 . . . LKB2 is V/2. The voltage at hot end 45 of each of first luminaires L1A . . . LKA is V and the voltage at hot end 45 of each of second luminaires L1B . . . LKB is −V. The voltage at cold end 55 of each of luminaires L1A, L1B . . . LKA, LKB is about 0. The voltage difference between hot ends 45 and cold ends 55, stacked vertically one above the other, is thus consistently V.

Figure 6:
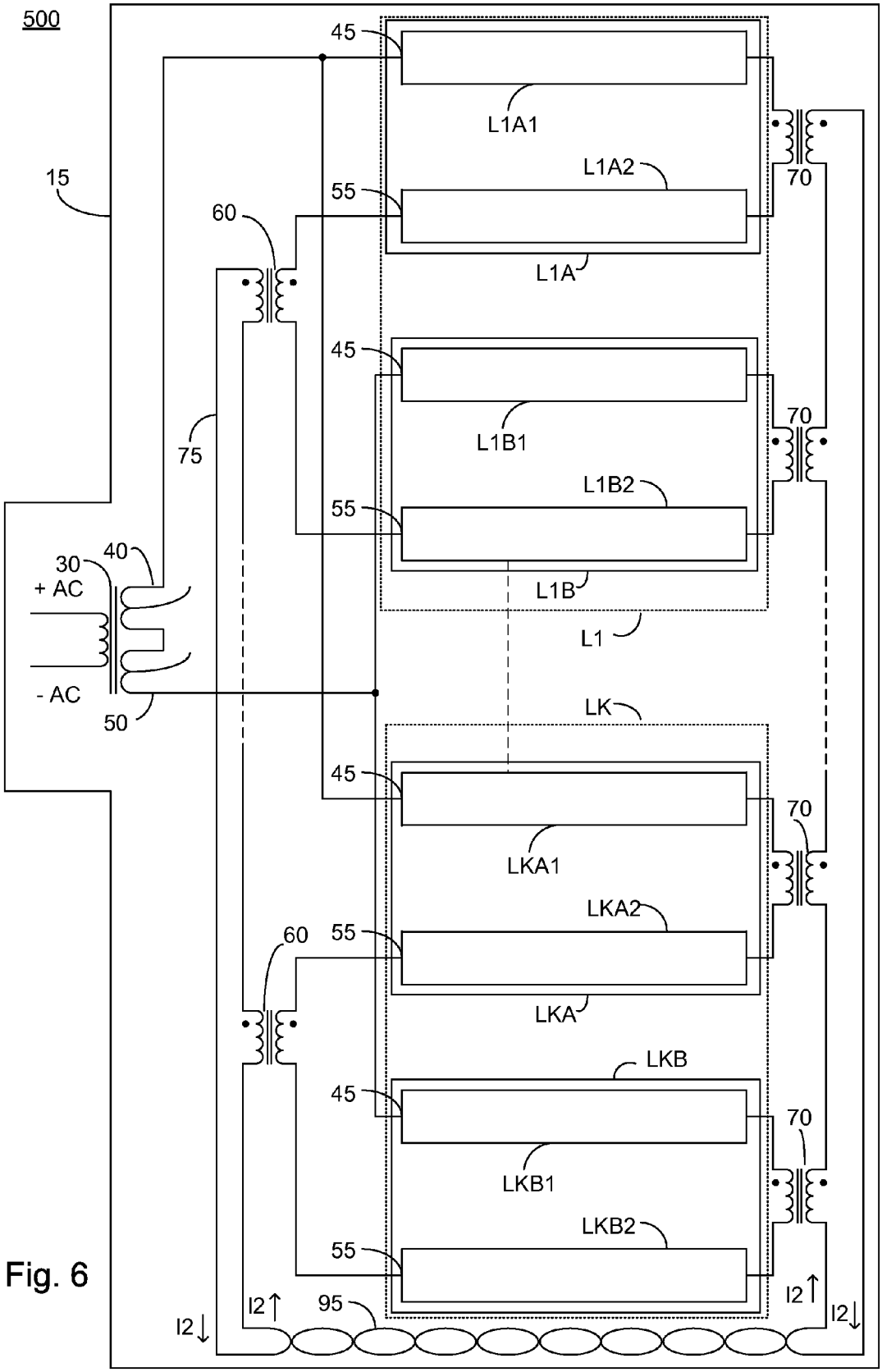
FIG. 6 illustrates a high level block diagram of an embodiment of a backlighting arrangement comprising a plurality of luminaires each constituted of a pair of linear lamps, with a single balancing transformer for each pair of luminaires, wherein the lamps are arranged such that adjacent ends of the luminaires exhibit a uniform voltage difference there between, wherein an additional balancing transformer is provided for each luminaire connected between the constituent linear lamps.

FIG. 6 illustrates a high level block diagram of an embodiment of a backlighting arrangement 500 comprising a plurality of pairs of luminaires L1 . . . LK, a driving transformer 35 exhibiting a pair of secondary windings 36 and 38, a plurality of first balancing transformers 60, and a plurality of second balancing transformers 70, all of which are disposed within a chassis 15. Each of the plurality of pairs of luminaires L1 . . . LK comprises a first luminaire L1A . . . LKA, respectively, and a second luminaire L1B . . . LKB, respectively. Each of first and second luminaires L1A, L1B . . . LKA, LKB comprises a first linear lamp L1A1, L1B1 . . . LKA1, LKB1, respectively, and a second linear lamp L1A2, L1B2 . . . LKA2, LKB2, respectively. A first end of each of first linear lamps L1A1, L1B1 . . . LKA1, LKB1 constitutes a hot end 45 of the respective one of first and second luminaires L1A, L1B . . . LKA, LKB, and a first end of each of second lamps L1A2, L1B2 . . . LKA2, LKB2 constitutes a cold end 55 of the respective one of first and second luminaires L1A, L1B . . . LKA, LKB.

Each pair of luminaires L1 . . . LK has associated therewith a single balancing transformer 60. Each of first and second luminaires L1A, L1B, LKA, LKB has associated therewith a second additional balancing transformer 70. Each second lamp of first luminaire L1A2 . . . LKA2 is adjacent to the first lamp of respective second luminaire L1B2 . . . LKB2. Hot ends 45 and cold ends 55 of each of first and second luminaires L1A, L1B . . . LKA, LKB are in physical proximity of driving transformer 35, in physical proximity of balancing transformers 60, and preferably generally define a first plane. First and second linear lamps L1A1, L1A2, L1B1, L1B2 . . . LKA1, LKB1, LKA2, LKB2 are arranged in parallel, generally extend axially away from the proximity of driving transformer 35 and generally define a second plane preferably orthogonal to the plane defined by hot ends 45 and cold ends 55. It is to be noted that hot ends 45 and cold ends 55 are stacked vertically appearing alternately, and not in stacked pairs. A second end of each of first lamps UAL L1B1 . . . LKA1, LKB1, is connected via a primary winding of a respective additional balancing transformer 70 to a second end of respective second lamp L1A2, L1B2 . . . LKA2, LKB2.

A first end of secondary winding 36 of driving transformer 35, denoted first output 40, is connected to hot end 45 of each of first luminaires L1A . . . LKA. A first end of second secondary winding 38 of driving transformer 35, denoted second output 50, is connected to hot end 45 of each of second luminaires L1B . . . LKB. A first end of the primary winding of each first balancing transformer 60 is connected to cold end 55 of each of the respective associated first luminaire L1A . . . LKA, and a second end of the primary winding of each first balancing transformer 60 is connected to cold end 55 of each of the respective associated second luminaire L1B . . . LKB. The secondary windings of first balancing transformers 60 and second balancing transformers 70 are connected in a closed loop 75, in which the polarity of the secondary windings are arranged so that voltages induced in the secondary windings are in phase and add within the closed loop. Preferably a single twisted wire pair 95 is arranged to connect the portion of closed loop 75 associated with second balancing transformers 70 with the portion of closed loop 75 associated with first balancing transformers 60. Thus, a balanced current I2 is exhibited flowing in each direction of twisted wire pair 95 as it traverses the length of chassis 15 reducing any electromagnetic interference.

In operation lighting arrangement 500 operates in all respects similar to the operation of lighting arrangement 300. Advantageously, as described above in relation to FIG. 5, because hot end 45 of each of first luminaires L1A . . . LKA is adjacent to a cold end 55 of a respective one of second luminaires L1B . . . LKB, the voltage drop between each adjacent lamp ends are substantially equal, thereby receiving better brightness distribution.

Figure 7:
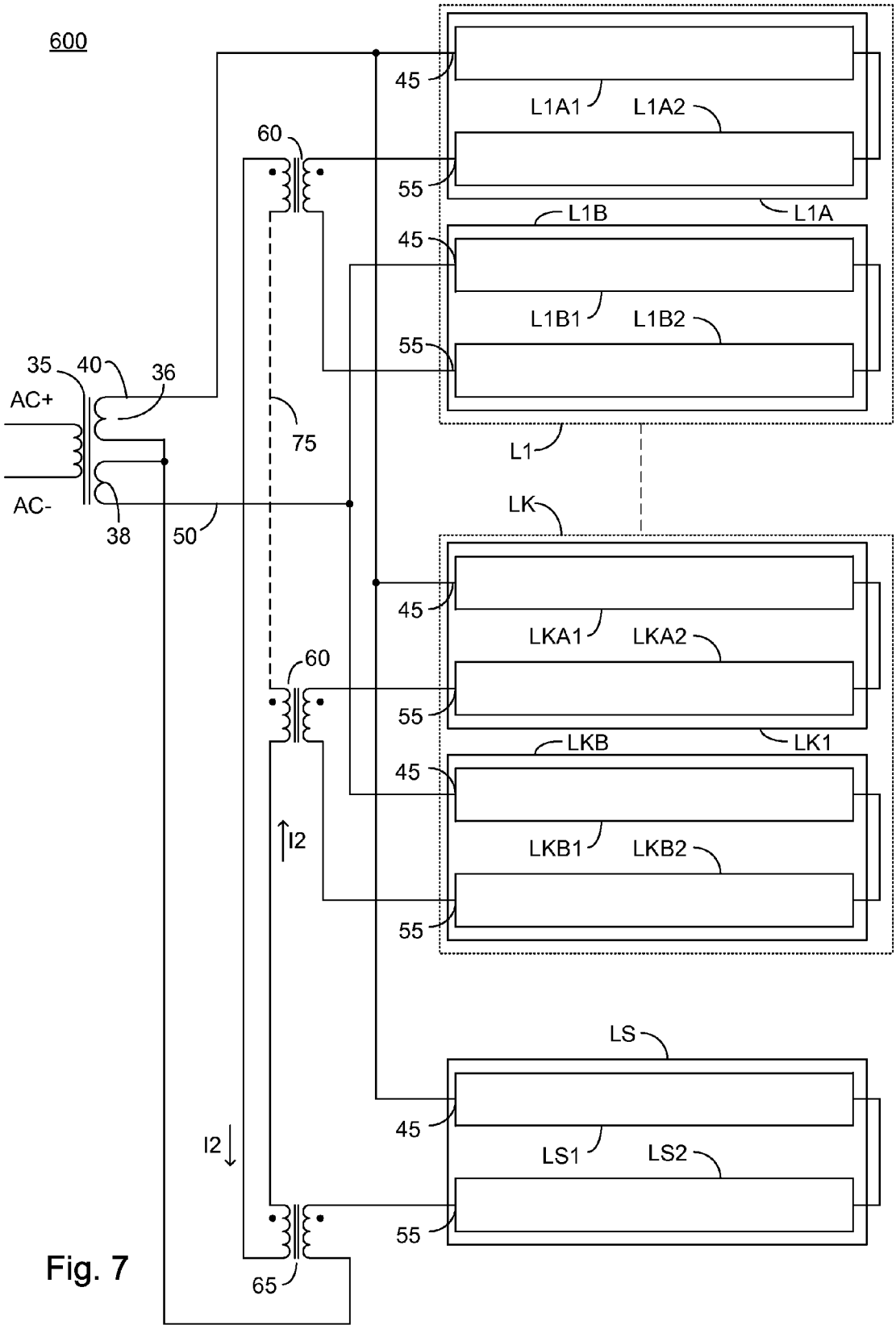
FIG. 7 illustrates a high level block diagram of an embodiment of a backlighting arrangement comprising an odd number of luminaires each constituted of a pair of linear lamps, with a single balancing transformer for each pair of luminaires, and a balancing transformer for the odd luminaire, wherein the balancing transformer of the odd luminaire is connected to a low voltage point.

FIG. 7 illustrates a high level block diagram of an embodiment of a backlighting arrangement 600 comprising a plurality of pairs of luminaires L1 . . . LK, a luminaire LS, a driving transformer 35 exhibiting a pair of secondary windings 36 and 38, and a plurality of balancing transformers 60, all of which are disposed within a chassis 15. Each of the plurality of pairs of luminaires L1 . . . LK comprises a first luminaire L1A . . . LKA, respectively, and a second luminaire L1B . . . LKB, respectively. Each of first and second luminaires L1A, L1B . . . LKA, LKB comprises a first linear lamp L1A1, L1B1 . . . LKA1, LKB1, respectively, and a second linear lamp L1A2, L1B2 . . . LKA2, LKB2, respectively. Luminaire LS comprises a first linear lamp LS1 and a second linear lamp LS2. A first end of each of first linear lamps L1A1, L1B1 . . . LKA1, LKB1, LS1 constitutes a hot end 45 of the respective one of first and second luminaires L1A, L1B . . . LKA, LKB, and luminaire LS, and a first end of each of second linear lamps L1A2, L1B2 . . . LKA2, LKB2, LS2 constitutes cold end 55 of the respective one of first and second luminaires L1A, L1B . . . LKA, LKB, and luminaire LS.

Each pair of luminaires L1 . . . LK has associated therewith a single balancing transformer 60, and luminaire LS has associated therewith a single balancing transformer 65. Hot ends 45 and cold ends 55 of each of first and second luminaires L1A, L1B . . . LKA, LKB, and luminaire LS are in physical proximity of driving transformer 35, e.g. on the same side of chassis 15 as driving transformer 35, in physical proximity of balancing transformers 60 and 65, and preferably generally define a first plane. First and second linear lamps L1A1, L1A2, L1B1, L1B2 . . . LKA1, LKB1, LKA2, LKB2, LS1 and LS2 are arranged in parallel, generally extend axially away from the proximity of driving transformer 35 and generally define a second plane preferably orthogonal to the plane defined by hot ends 45 and cold ends 55. It is to be noted that hot ends 45 and cold ends 55 are stacked vertically appearing in alternately. A second end each of first lamps L1A1, L1B1 . . . LKA1, LKB1, is connected to a second end of respective second lamp L1A2, L1B2 . . . LKA2, LKB2. A second end of first lamp LS1 is connected to a second end of second lamp LS2.

A first end of secondary winding 36 of driving transformer 35, denoted first output 40, is connected to hot end 45 of each of first luminaires L1A . . . LKA and luminaire LS. A first end of second secondary winding 38 of driving transformer 35, denoted second output 50, is connected to hot end 45 of each of second luminaires L1B . . . LKB. A second end of secondary winding 36 is connected to a second end of secondary winding 38 and to a first end of the primary winding of balancing transformer 65. A first end of the primary winding of each balancing transformer 60 is connected to cold end 55 of each of the respective associated first luminaires L1A . . . LKA, and a second end of the primary winding of each balancing transformer 60 is connected to cold end 55 of each of the respective associated second luminaires L1B . . . LKB. A second end of the primary winding of balancing transformer 65 is connected to cold end 55 of luminaire LS. The secondary windings of the balancing transformers 60 and balancing transformer 65 are connected in closed loop 75, in which the polarity of the secondary windings are arranged so that voltages induced in the secondary windings are in phase and add within the closed loop.

In operation lighting arrangement 600 operates in all respects similar to the operation of lighting arrangement 200, except as described below. Advantageously, as described above in relation to FIG. 5, because cold end 55 of each of first luminaires L1A . . . LKA is adjacent to a hot end 55 of respective one of second luminaires L1B . . . LKB, and similarly hot end 45 of luminaire LS is stacked adjacent to cold end 55 of second luminaire LKB, the voltage drop between each adjacent lamp is substantially equal, thereby achieving improved brightness distribution. Differently from FIG. 3, the primary winding of balancing transformer 65 is connected between cold end 55 of luminaire LS and the common connection between secondary windings 36 and 38 of drive transformer 35. In such an arrangement only the voltage from secondary winding 36 is applied to luminaire LS, i.e. about ½ of the voltage applied to each of luminaire pairs L1 . . . LK, and the primary winding of balancing transformer 65 does not need to develop a balancing voltage as it does in lighting arrangement 200. Balancing transformer 65 preferably exhibits the same number of winding turns as each of balancing transformers 60. The current flowing through secondary windings 36 is greater than the current through secondary winding 38, however this does not affect the operation of transformer 35.

Figure 8:
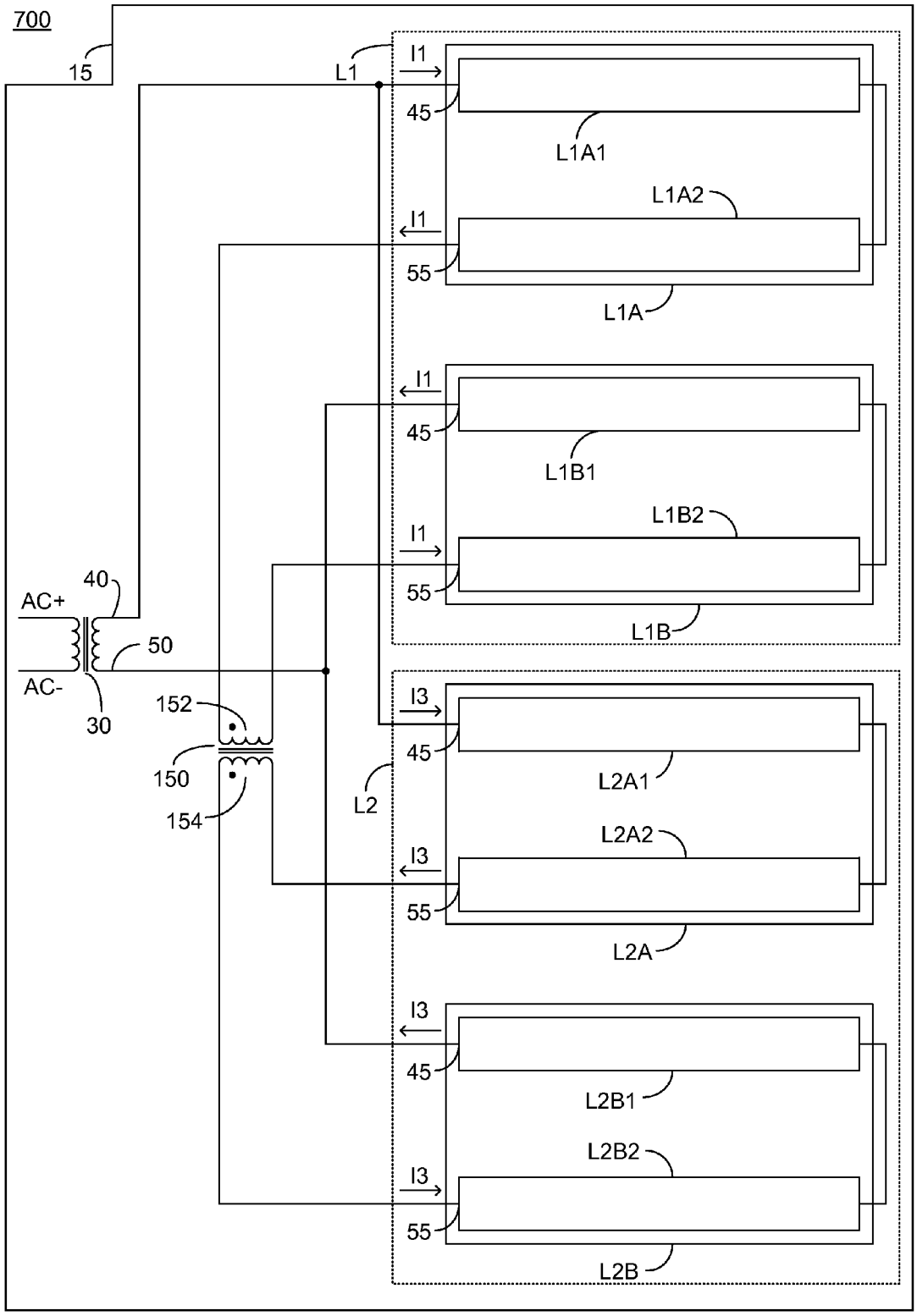
FIG. 8 illustrates a high level block diagram of an embodiment of a backlighting arrangement comprising four luminaries, each constituted of a pair of linear lamps, with a single balancing transformer for the four luminaires.

FIG. 8 illustrates a high level block diagram of an embodiment of a backlighting arrangement 700 comprising a first luminaire pair L1 and a second luminaire pair L2, a driving transformer 30, and a single balancing transformer 150, all of which are disposed within a chassis 15. Balancing transformer 150 exhibits first winding 152 and second winding 154, and the turns ratio of balancing transformer 150 is preferably 1:1.

Luminaire pair L1 comprises first luminaire L1A and second luminaire L1B, and luminaire pair L2 comprises first luminaire L2A and second luminaire L2B. Each of first luminaires L1A, L2A, comprises a first linear lamp UAL L2A1, respectively, and a second linear lamp L1A2, L2A2, respectively. Each of second luminaires L1B, L2B, comprises a first linear lamp L1B1, L2B1, respectively, and a second linear lamp L1B2, L2B2, respectively. A first end of each of first linear lamps UAL L1B1, L2A1, L2B1 constitutes hot end 45 of the respective one of luminaires L1A, L1B, L2A, L2B and a first end of each of second linear lamps L1A2, L1B2, L2A2, L2B2 constitutes a cold end 55 of the respective one of luminaires L1A, L1B, L2A, L2B.

Hot ends 45 and cold ends 55 of each of first and second luminaires L1A, L1B, L2A, L2B are in physical proximity of driving transformer 30, in physical proximity of balancing transformer 150, and preferably generally define a first plane at one side of chassis 15. First and second linear lamps L1A1, L1A2, L1B1, L1B2, L2A1, L2A2, L2B1, L2B2 are arranged in parallel, generally extend axially away from the proximity of driving transformer 30 and generally define a second plane preferably orthogonal to the plane defined by hot ends 45 and cold ends 55. It is to be noted that hot ends 45 and cold ends 55 are stacked vertically appearing alternately, and not in stacked pairs. A second end of each of first linear lamps L1A1, L1B1, L2A1, L2B1 is connected to a second end of respective second lamps L1A2, L1B2, L2A2, L2B2. It is to be noted that hot ends 45 and cold ends 55 are stacked vertically appearing alternately.

A first end of the secondary winding of driving transformer 30, denoted first output 40, is connected to hot end 45 of each of first luminaires L1A and L2A. A second end of the secondary winding of driving transformer 30, denoted second output 50, is connected to hot end 45 of each of second luminaires L1B and L2B. A first end of winding 152 of balancing transformer 150 is connected to cold end 55 of first luminaire L1A, and a second end of winding 152 of balancing transformer 150 is connected to cold end 55 of second luminaire L1B. A first end of winding 154 of balancing transformer 150 is connected to cold end 55 of first luminaire L2A, and a second end of winding 154 of balancing transformer 150 is connected to cold end 55 of second luminaire L2B.

In operation, power is output from driving transformer 30 as described above in relation to FIG. 1. For simplicity, we designate first output 40 as AC+ and second output 50 as AC−, which is appropriate for ½ the drive cycle. During the second half of the drive cycle, polarity is reversed and the direction of current flow is reversed.

A current is developed through the secondary winding of driving transformer 30, responsive to AC+ at first output 40, a current I1 is driven through hot end 45 of first luminaire L1A into first linear lamp L1A1, and a current I3 is driven through hot end 45 of first luminaire L2A into first linear lamp L2A1. Current I1 further flows through second linear lamp L1A2, exits cold side 55 of first luminaire L1A and enters winding 152 of balancing transformer 150. Current I1 exits winding 152, enters cold side 55 of second luminaire L1B, and flows through second and first linear lamps L1B2 and L1B1, exits hot side 45 of second luminaire L1B, and is returned to the secondary winding of transformer 30 at second output 50. Current I3 further flows through second linear lamp L2A2, exits cold side 55 of first luminaire L2A and enters winding 154 of balancing transformer 150. Current I3 exits winding 152, enters cold side 55 of second luminaire L2B, and flows through second and first linear lamps L2B2 and L2B1, exits hot side 45 of second luminaire L2B, and is returned to the secondary winding of transformer 30 at second output 50.

As the turns ratio of windings 152 and 154 of balancing transformer 150 is preferably 1:1, current I1 is forced to equal current I3. Thus, equal current is maintained through all of first and second luminaires L1A, L1B, L2A, L2B by providing only one balancing transformer 150. As described above in relation to FIG. 5, by proper arrangement vertically of first and second luminaires L1A, L1B, L2A, L2B, the voltage drop between each adjacent lamp is equal thereby achieving an improved brightness distribution.

FIGS. 2, 3, 5, 7 and 8 have been described in an embodiment in which the constituent luminaires comprise pairs of linear lamps, however this is not meant to be limiting in any way. In another embodiment, any or all of the luminaires can comprise a U-shaped lamp without exceeding the scope.

Advantageously, the above embodiments exhibits an improved average brightness horizontally, since the hot sides of the luminaires and the cold sides of the luminaires appear vertically stacked on the same side of the panel. The average brightness of the stacked hot and cold sides is thus nearly equal the average brightness on the far side of the panel.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof which would occur to persons skilled in the art upon reading the foregoing description and which are not in the prior art.

I claim:

1. A backlighting arrangement comprising:

a driving transformer;

at least one balancing transformer; and a plurality of luminaires, each of said plurality of luminaires constituted of one of a U-shaped lamp and a pair of linear lamps which are directly serially connected to each other, a first end of each of said plurality of luminaires connected to a high voltage lead of said driving transformer and a second end of each of said plurality of luminaires connected to a unique end of a winding of said at least one balancing transformer, wherein each pair of said luminaires is associated with a particular winding of one of said at least one balancing transformers, a first luminaire of said pair connected to a first end of said particular winding and a second luminaire of said pair connected to second end of said particular winding, said second end different from said first end, and wherein said first end and said second end of each of said luminaires is in physical proximity of said driving transformer and said at least one balancing transformer, said constituent lamps of said luminaires arranged in parallel and generally extending axially away from said proximity of said driving transformer.

2. A backlighting arrangement according to claim 1, wherein said plurality of luminaires is constituted of 4 luminaires, a first two of said luminaires connected to each end of a primary winding of a single balancing transformer and a second two of said luminaires connected to each end of a secondary winding of said single balancing transformer.

3. A backlighting arrangement according to claim 1, comprising at least two balancing transformers, wherein said particular winding of said balancing transformers is a primary winding, each of said balancing transformers comprising a secondary winding magnetically coupled to said primary winding, said secondary windings of said balancing transformers serially connected in a closed in-phase loop.

4. A backlighting arrangement according to claim 3, comprising an odd number of luminaires wherein one of said luminaires does not participate in any of said pairs, the second end of the primary winding of the balancing transformer associated with said not participating luminaire connected to a high voltage lead of said driving transformer.

5. A backlighting arrangement according to claim 3, comprising an odd number of luminaires wherein one of said luminaires does not participate in any of said pairs, and wherein said driving transformer exhibits a pair of secondary windings, a first end of each of said secondary windings being connected together, and wherein said high voltage leads of said driving transformer are associated with a second end of each of said secondary windings, the second end of the primary winding of the balancing transformer associated with said not participating luminaire connected to said first end of said secondary windings of said driving transformer.

6. A backlighting arrangement according to claim 3, wherein each of said luminaires is constituted of said pair of serially directly connected linear lamps, and further comprising an additional balancing transformer associated with each of said luminaires, a primary winding of said associated additional balancing transformer connected between said serially directly connected linear lamps, a secondary winding of each of said additional balancing transformers being serially connected in said closed in-phase loop.

7. A backlighting arrangement according to claim 3, wherein a current sensing arrangement is provided within said serially connected closed in-phase loop.

8. A backlighting arrangement according to claim 1, wherein said luminaires are arranged so that adjacent ends of said luminaires exhibit a uniform voltage difference there between.

9. A backlighting arrangement according to claim 1, wherein said driving transformer exhibits a pair of secondary windings, a first end of each of said secondary windings being connected to a common point via a unique sense resistor, and wherein said high voltage leads of said driving transformer are associated with a second end of each of said secondary windings.

10. A backlighting arrangement according to claim 1, wherein said driving transformer exhibits a pair of secondary windings, a first end of each of said secondary windings being connected together, and wherein said high voltage leads of said driving transformer are associated with a second end of each of said secondary windings.

11. A backlighting arrangement comprising:

an alternating current voltage source, comprising a first and a second voltage lead;

at least one balancing transformer; and a plurality of luminaires, each of said plurality of luminaires constituted of one of a U-shaped lamp and a pair of linear lamps which are directly serially connected to each other, a first end of each of said plurality of luminaires connected to one of said first and second voltage leads and a second end of each of said plurality of luminaires connected to a unique end of a winding of said at least one balancing transformer, wherein each pair of said luminaires is associated with a particular winding of one of said at least one balancing transformers, a first luminaire of said pair connected to a first end of said particular winding and a second luminaire of said pair connected to second end of said particular winding, said second end different from said first end, and wherein said first end and said second end of each of said luminaires are generally spatially aligned to define a first plane, said constituent lamps of said luminaires arranged in parallel and generally defining a second plane orthogonal to said first plane.

12. A backlighting arrangement according to claim 11, wherein said plurality of luminaires is constituted of 4 luminaires, a first two of said luminaires connected to each end of a primary winding of a single balancing transformer and a second two of said luminaires connected to each end of a secondary winding of said single balancing transformer.

13. A backlighting arrangement according to claim 11, comprising at least two balancing transformers, wherein said particular winding of said balancing transformers is a primary winding, each of said balancing transformers comprising a secondary winding magnetically coupled to said primary winding, said secondary windings of said balancing transformers serially connected in a closed in-phase loop.

14. A backlighting arrangement according to claim 13, comprising an odd number of luminaires wherein one of said luminaires does not participate in any of said pairs, the second end of the primary winding of the balancing transformer associated with said not participating luminaire connected to one of said first and second voltage leads.

15. A backlighting arrangement according to claim 13, comprising an odd number of luminaires wherein one of said luminaires does not participate in any of said pairs, and wherein said alternating current voltage source comprises a driving transformer exhibiting a pair of secondary windings, a first end of each of said secondary windings being connected together, and wherein said high voltage leads of said driving transformer are associated with a second end of each of said secondary windings, the second end of the primary winding of the balancing transformer associated with said not participating luminaire connected to said first end of said secondary windings of said driving transformer.

16. A backlighting arrangement according to claim 13, wherein each of said luminaires is constituted of said pair of serially directly connected linear lamps, and further comprising an additional balancing transformer associated with each of said luminaires, a primary winding of said associated additional balancing transformer connected between said serially connected linear lamps, a secondary winding of each of said additional balancing transformers being serially connected in said closed in-phase loop.

17. A backlighting arrangement according to claim 13, wherein a current sensing arrangement is provided within said serially connected closed in-phase loop.

18. A backlighting arrangement according to claim 11, wherein said luminaires are arranged so that adjacent ends of said luminaires exhibit a uniform voltage difference there between.

19. A backlighting arrangement according to claim 11, wherein said alternating current voltage source comprises a driving transformer exhibiting a pair of secondary windings, a first end of each of said secondary windings being connected to a common point via a unique sense resistor, and wherein said voltage leads of said driving transformer are associated with a second end of each of said secondary windings.

20. A backlighting arrangement according to claim 11, wherein said alternating current voltage source comprises a driving transformer exhibiting a pair of secondary windings, a first end of each of said secondary windings being connected together, and wherein said voltage leads of said driving transformer are associated with a second end of each of said secondary windings.

21. A method of backlighting comprising:

receiving an alternating current voltage;

providing at least one balancing transformer;

providing a plurality of luminaires, each of said plurality of luminaires constituted of one of a U-shaped lamp and a pair of linear lamps which are directly serially connected to each other;

connecting a first end of each of said provided plurality of luminaires to one polarity of said received alternating current voltage;

connecting a second end of each of said provided plurality of luminaires to a unique end of a winding of said at least one balancing transformer, wherein each pair of said luminaires is associated with a particular winding of one of said at least one balancing transformers, a first luminaire of said pair connected to a first end of said particular winding and a second luminaire of said pair connected to second end of said particular winding, said second end different from said first end; and spatially arranging said provided luminaires so that said first end and said second end of each of said luminaires generally define a first plane, said constituent lamps of said luminaires generally defining a second plane orthogonal to said first plane.

* * * * *